US011497679B2

(12) United States Patent
Headen et al.

(10) Patent No.: US 11,497,679 B2
(45) Date of Patent: Nov. 15, 2022

(54) GENITAL STEAMING ASSEMBLY

(71) Applicants: Anjoli Headen, Stockbridge, GA (US); Angela Headen, Stockbridge, GA (US)

(72) Inventors: Anjoli Headen, Stockbridge, GA (US); Angela Headen, Stockbridge, GA (US)

( * ) Notice: Subject to any disclaimer, the term of this patent is extended or adjusted under 35 U.S.C. 154(b) by 604 days.

(21) Appl. No.: 16/573,044

(22) Filed: Sep. 17, 2019

(65) Prior Publication Data

US 2021/0077348 A1 Mar. 18, 2021

(51) Int. Cl.
*A61H 35/00* (2006.01)
*A61H 33/06* (2006.01)

(52) U.S. Cl.
CPC ..... *A61H 35/00* (2013.01); *A61H 33/065* (2013.01); *A61H 2033/068* (2013.01); *A61H 2201/5025* (2013.01); *A61H 2201/5043* (2013.01); *A61H 2205/087* (2013.01)

(58) Field of Classification Search
CPC ..... A61H 35/00
USPC ..... 607/84, 83, 85, 86, 87; 4/537
See application file for complete search history.

(56) References Cited

U.S. PATENT DOCUMENTS 1,358,060 A * 11/1920 Crum ..... A61H 33/06 454/197
1,476,460 A * 12/1923 Osborn ..... A61H 33/06 607/87
2,014,185 A * 9/1935 Martin ..... A45D 20/22 34/100
2,093,648 A * 9/1937 Rice ..... A61G 11/00 392/394
2,199,285 A * 4/1940 Fenton ..... A61H 33/06 4/531
2,210,373 A * 8/1940 Larson ..... A61M 11/041 607/84
2,223,669 A * 12/1940 Forshee ..... A61H 33/06 165/223
2,292,666 A * 8/1942 Schurtz ..... A61H 9/00 4/537
2,346,827 A * 4/1944 Cotter ..... A61H 33/06 604/312
2,507,815 A * 5/1950 Rice ..... A61H 33/06 604/23
2,539,710 A * 1/1951 Sziklay ..... A61H 33/06 607/83
3,110,797 A * 11/1963 Vanne ..... A61H 33/063 126/400

(Continued)

FOREIGN PATENT DOCUMENTS

GB 2248183 A * 4/1992 ..... A61H 33/063
JP 2004-249054 A * 9/2004 ..... A61F 7/00
WO WO-2016017900 A1 * 2/2016 ..... A61F 7/00

*Primary Examiner* — Lori L Baker

(57) ABSTRACT

A genital steaming assembly includes a heating unit that is positionable on a support surface. A canister is removably coupled to the heating unit such that the canister is in thermal communication with the heating unit. Fluid is poured into the canister such that the heating unit can heat the fluid into a steam. A box is provided and the box is positionable over the heating unit for has a user to sit upon the box. The box has a steam opening therein to direct the steam onto the user's genitalia for therapeutic purposes. The box is collapsible between a deployed position and a collapsed position. Moreover, the box completely surrounds the heating unit to capture the steam for directing onto the user's genitalia.

13 Claims, 6 Drawing Sheets

(56) References Cited

U.S. PATENT DOCUMENTS 3,275,800 A * 9/1966 Kuoppamaki ..... A61H 33/063 219/486
3,416,529 A * 12/1968 Weisman ..... A47K 3/122 607/86
3,463,160 A 8/1969 Halonen
3,493,722 A * 2/1970 Popeil ..... A45D 4/16 D28/38
3,707,971 A * 1/1973 Yamamoto ..... A61H 33/12 4/537
3,708,651 A * 1/1973 Neville ..... A61H 33/063 392/374
3,772,713 A * 11/1973 Roullier ..... A61H 33/06 607/83
3,851,340 A * 12/1974 Keusch ..... A47K 3/022 220/555
3,885,557 A * 5/1975 Varea ..... A61H 33/06 601/158
4,031,573 A * 6/1977 Romanoff ..... A61H 33/06 607/83
4,044,772 A * 8/1977 Schloss ..... A61H 33/06 4/524
4,119,686 A * 10/1978 Conger, IV ..... A61H 33/6063 261/DIG. 75
4,121,571 A * 10/1978 Pickering ..... A61G 11/00 128/205.26
4,197,838 A * 4/1980 Shill ..... A61G 7/1096 5/602
4,277,855 A * 7/1981 Poss ..... A61H 33/06 4/531
4,292,971 A * 10/1981 Smit ..... A61H 33/12 604/289
4,314,138 A * 2/1982 Itoh ..... A61H 33/12 34/91
4,331,137 A * 5/1982 Sarui ..... A61M 11/005 604/293
4,370,764 A 2/1983 Ando
4,399,349 A * 8/1983 Deming ..... A61M 11/042 4/537
4,449,034 A * 5/1984 Taniguchi ..... A47C 7/74 219/217
4,497,313 A * 2/1985 Kurosawa ..... A61H 35/006 601/78
4,621,641 A * 11/1986 Frank ..... A61H 33/12 392/404
4,632,115 A * 12/1986 Bernardini ..... A61F 7/00 607/86
4,696,303 A * 9/1987 Bernardini ..... A61H 33/04 607/104
4,880,415 A * 11/1989 Urakami ..... A61F 7/0085 604/291
4,903,850 A * 2/1990 Frank ..... A61M 16/16 4/537
5,228,150 A * 7/1993 Parker ..... A61H 9/00 4/557
5,241,958 A * 9/1993 Noeldner ..... A61H 35/00 607/104
5,416,931 A * 5/1995 Wolfenden ..... A61H 33/06 607/81
5,425,753 A * 6/1995 Wege ..... A61H 35/00 607/83
5,441,529 A * 8/1995 Dorsch ..... A61H 9/00 607/82
5,519,900 A * 5/1996 Gardner ..... F24F 6/14 4/537
5,674,268 A * 10/1997 Riazi ..... A61F 7/00 607/114
5,741,317 A * 4/1998 Ostrow ..... A61N 1/325 607/81
5,870,780 A * 2/1999 Prommer ..... A61H 33/06 607/81
6,339,854 B1 * 1/2002 Amendt ..... A61H 33/06 607/83
6,385,795 B1 * 5/2002 Ferber ..... A61H 33/6089 607/86
6,393,633 B2 * 5/2002 Ferber ..... A61H 35/006 601/154
6,827,849 B2 * 12/2004 Kurokawa ..... A47K 3/022 210/175
6,904,624 B2 * 6/2005 Leung ..... A61H 33/12 4/525
7,819,007 B2 * 10/2010 Brooks ..... A61N 5/00 607/82
9,428,898 B1 * 8/2016 Clements ..... E03D 9/08
9,828,755 B1 * 11/2017 Clements ..... E03D 9/08
2003/0177571 A1 * 9/2003 Tadaka ..... A45D 44/00 4/537
2004/0260210 A1 * 12/2004 Ella ..... A61H 33/08 601/7
2008/0004677 A1 * 1/2008 Gay ..... A61H 23/04 4/584
2008/0031924 A1 * 2/2008 Gilson ..... A61N 5/0616 607/86
2008/0255637 A1 * 10/2008 Oishi ..... A61F 7/00 607/85
2008/0282459 A1 * 11/2008 Cline ..... E04H 4/129 4/493
2009/0112293 A1 * 4/2009 Haslauer ..... A61F 7/0053 607/85
2010/0204760 A1 * 8/2010 Lawliss ..... A61H 33/066 607/81
2013/0267890 A1 10/2013 Li
2014/0243590 A1 * 8/2014 Fang ..... A61H 23/02 600/38

* cited by examiner

GENITAL STEAMING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to steaming devices and more particularly pertains to a new steaming device for applying steam therapy to a user's genitalia.

(2) Description of Related Art Including Information Disclosed Under 37 CFR 1.97 and 1.98

The prior art relates to steaming devices.

BRIEF SUMMARY OF THE INVENTION

An embodiment of the disclosure meets the needs presented above by generally comprising a heating unit that is positionable on a support surface. A canister is removably coupled to the heating unit such that the canister is in thermal communication with the heating unit. Fluid is poured into the canister such that the heating unit can heat the fluid into a steam. A box is provided and the box is positionable over the heating unit for has a user to sit upon the box. The box has a steam opening therein to direct the steam onto the user's genitalia for therapeutic purposes. The box is collapsible between a deployed position and a collapsed position. Moreover, the box completely surrounds the heating unit to capture the steam for directing onto the user's genitalia.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
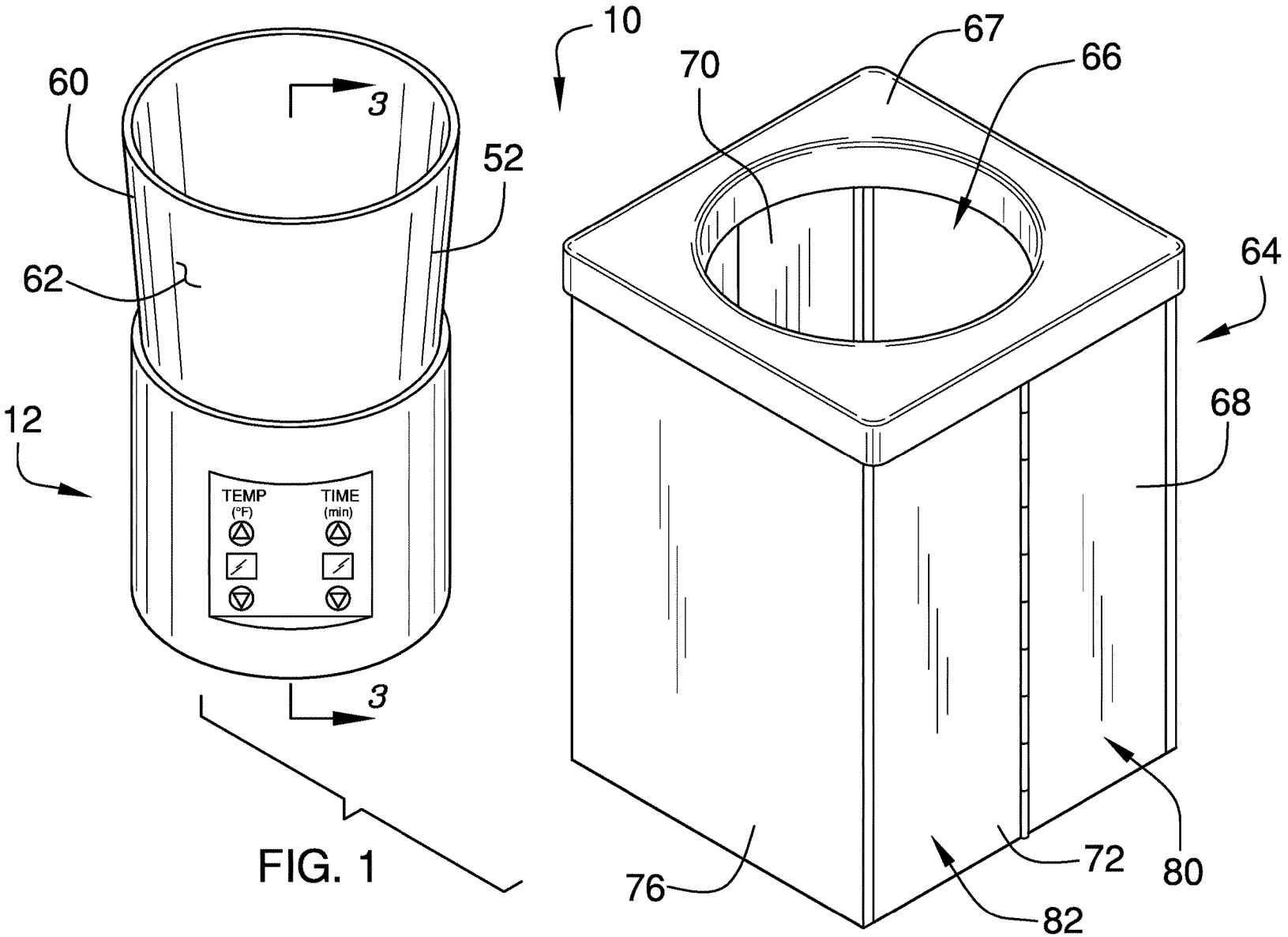
FIG. 1 is a perspective view of a genital steaming assembly according to an embodiment of the disclosure.
Figure 2:
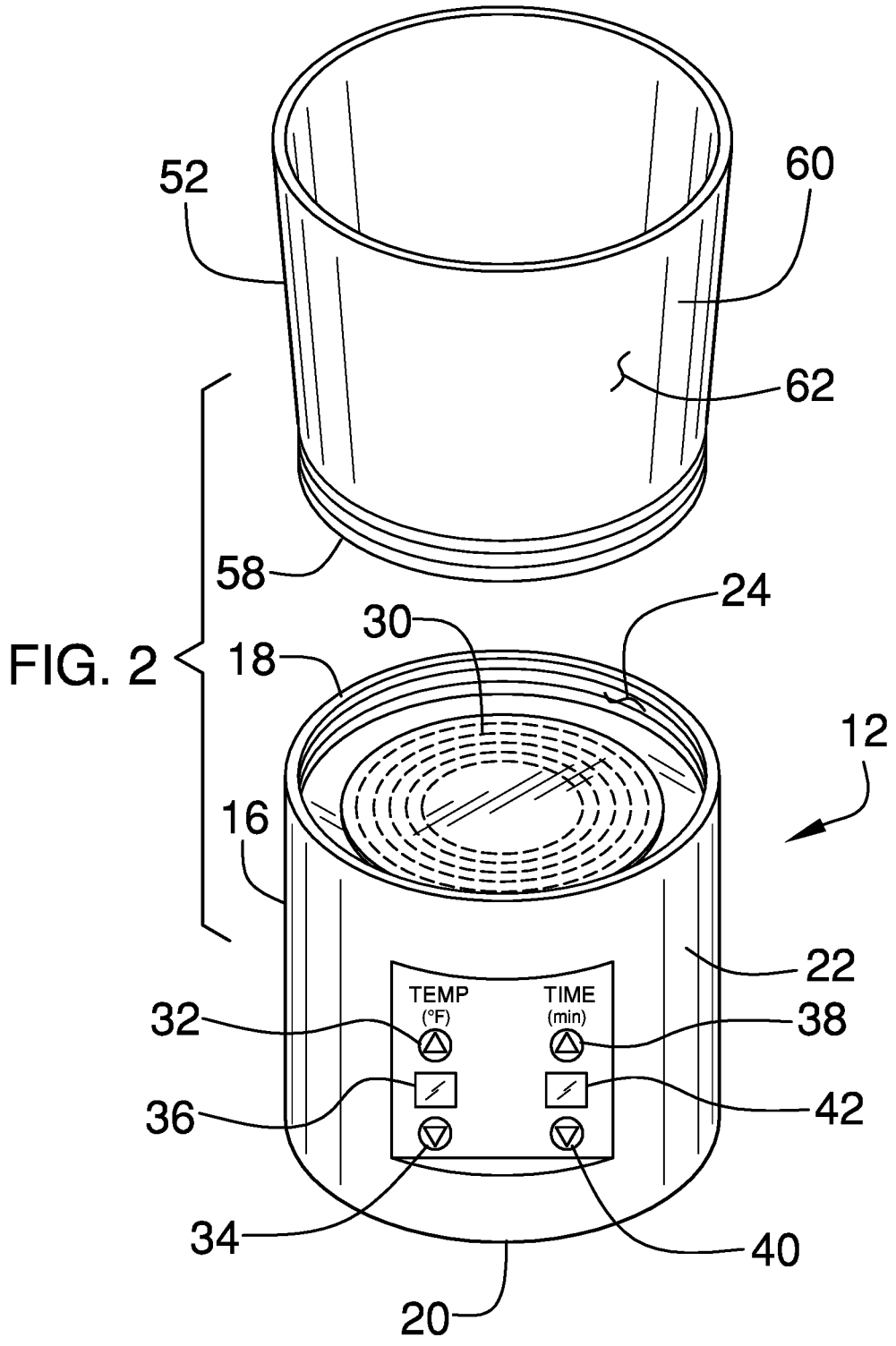
FIG. 2 is an exploded perspective view of an embodiment of the disclosure.
Figure 3:
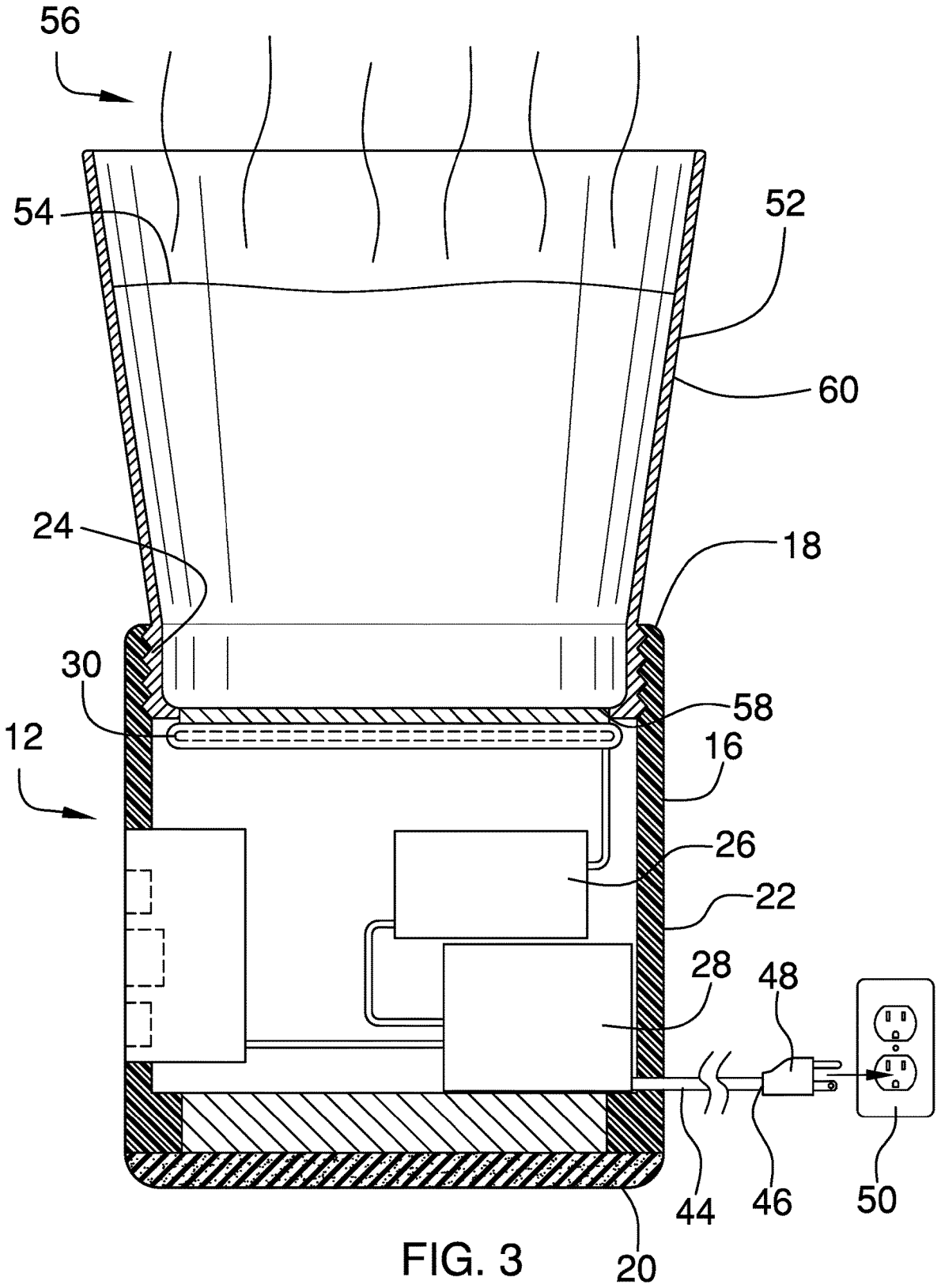
FIG. 3 is a cross sectional view taken along line 3-3 of FIG. 1 of an embodiment of the disclosure.
Figure 5:
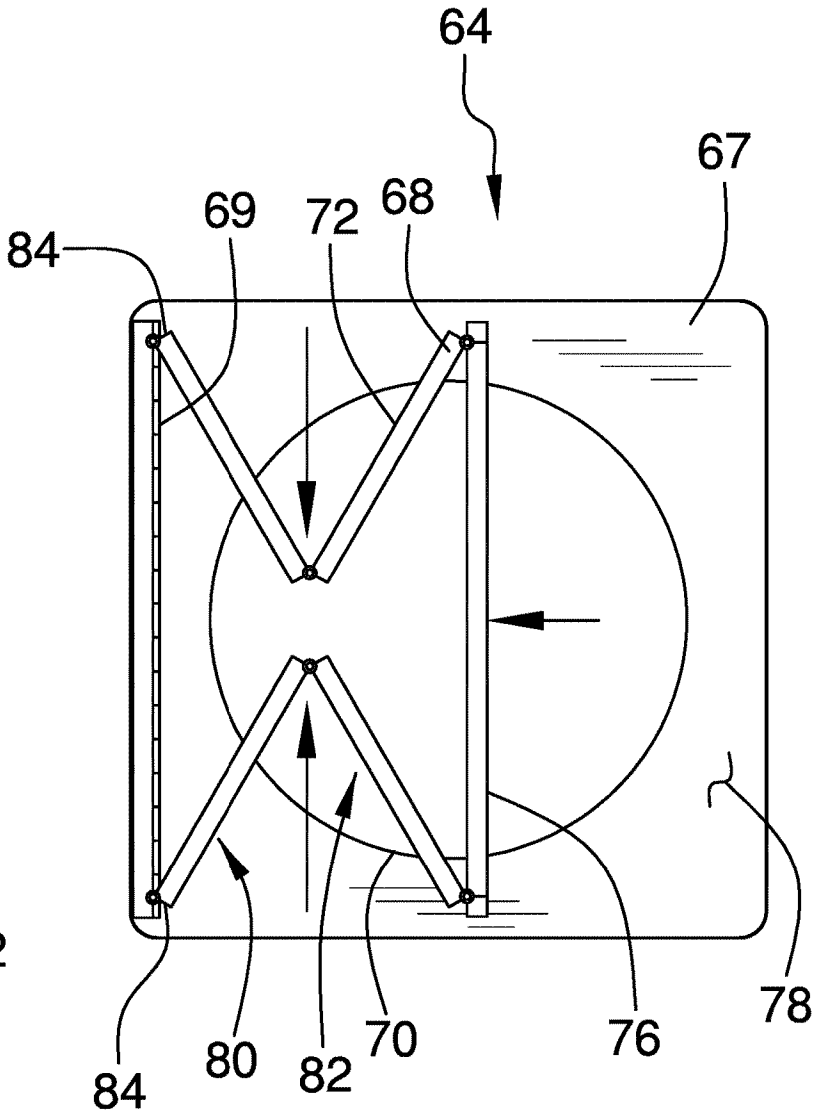
FIG. 5 is a bottom view of a box of an embodiment of the disclosure being moved into a collapsed position.
Figure 4:
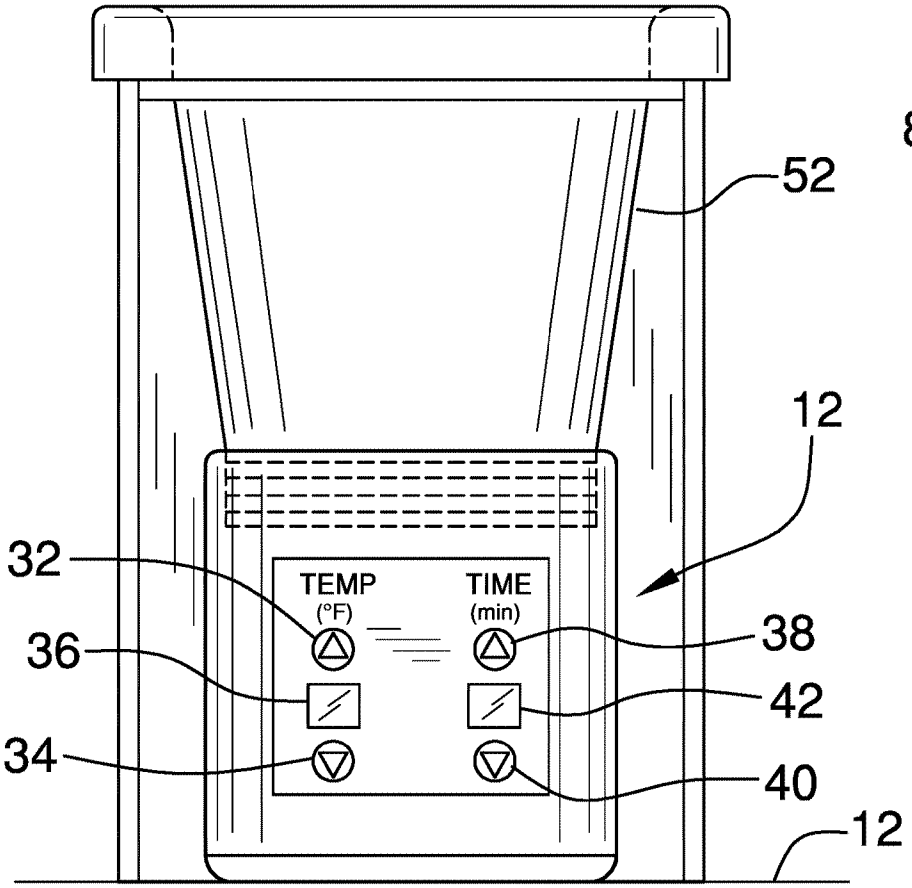
FIG. 4 is a front phantom view of an embodiment of the disclosure.
Figure 6:
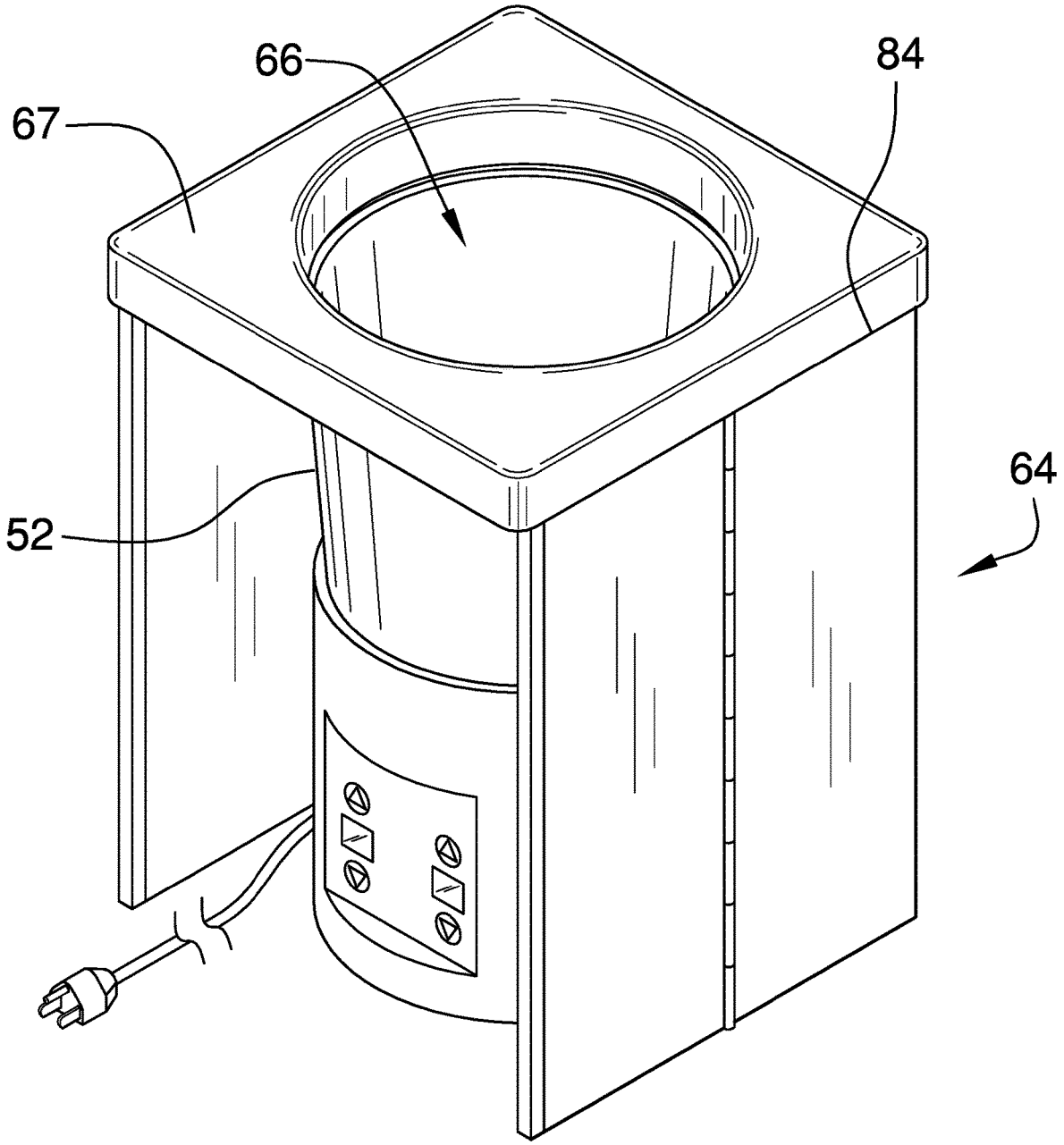
FIG. 6 is a front perspective view of an embodiment of the disclosure.
Figure 7:
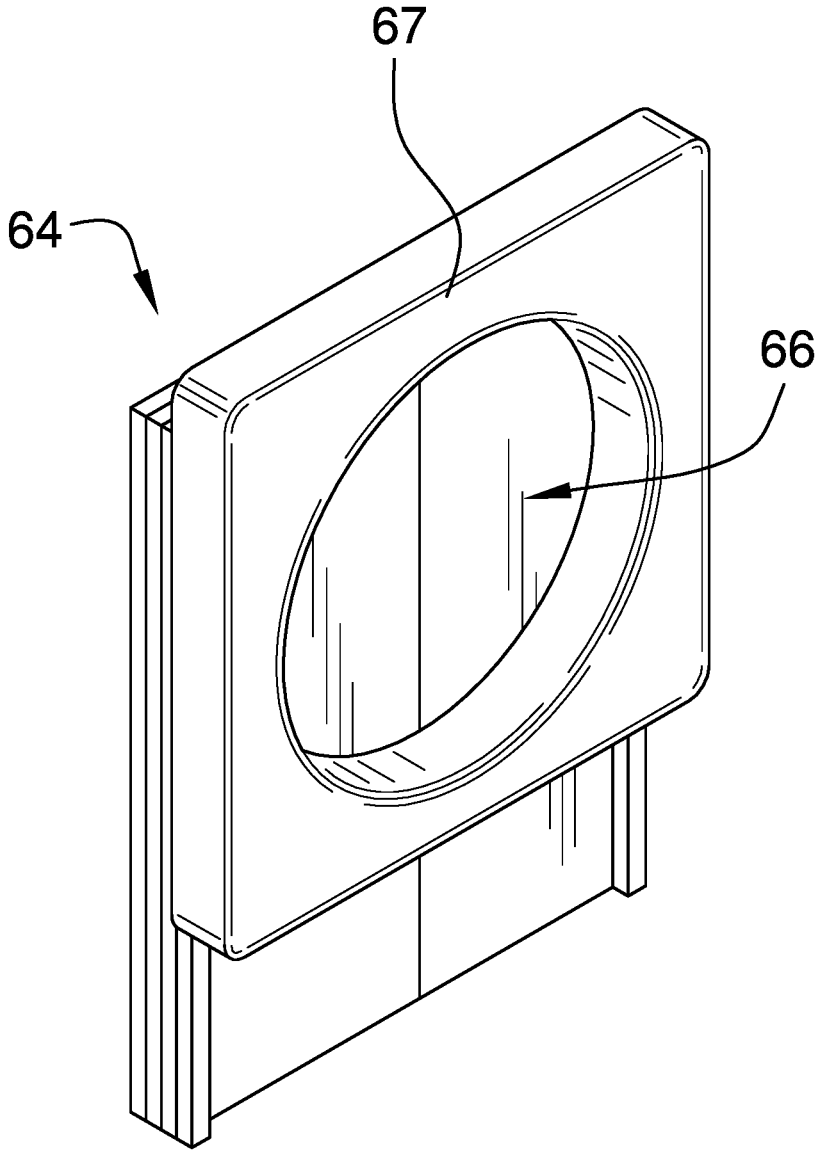
FIG. 7 is a perspective view of a box in a collapsed position.

With reference now to the drawings, and in particular to FIGS. 1 through 7 thereof, a new steaming device embodying the principles and concepts of an embodiment of the disclosure and generally designated by the reference numeral 10 will be described.

As best illustrated in FIGS. 1 through 7, the genital steaming assembly 10 generally comprises a heating unit 12 that is positionable on a support surface 14, such as a floor or other horizontal support surface 14. The heating unit 12 is adjustable between a minimum temperature and a maximum temperature. The heating unit 12 comprises a housing 16 that has a top end 18, a bottom end 20 and an outer wall 22 extending therebetween. The top end 18 is open, the outer wall 22 has an inside surface 24 and the inside surface 24 is threaded adjacent to the top end 18.

A control circuit 26 is coupled to the housing 16 and an electronic timer 28 is coupled to the housing 16. The electronic timer 28 is electrically coupled to the control circuit 26. A heating element 30 is positioned in the housing 16. The heating element 30 is spaced downwardly from the top end 18 of the housing 16 and the heating element 30 is electrically coupled to the control circuit 26. The heating element 30 is heated when the heating element 30 is turned on. Additionally, the heating element 30 may comprise an electric heating element that has an operational temperature sufficient to heat water to the point of producing steam 56.

A temperature increase button 32 is coupled to the outer wall 22 of the housing 16 and the temperature increase button 32 is electrically coupled to the control circuit 26. The temperature increase button 32 increases the temperature of the heating element 30 toward the maximum temperature. A temperature decrease button 34 is coupled to the outer wall 22 of the housing 16 and the temperature decrease button 34 is electrically coupled to the control circuit 26. The temperature decrease button 34 decreases the temperature of the heating element 30 toward the minimum temperature. A temperature display 36 is coupled to the outer wall 22 of the housing 16 and the temperature display 36 is electrically coupled to the control circuit 26. The temperature display 36 displays temperature indicia comprising numbers indicating the temperature to which the heating element 30 has been set. The temperature display 36 may comprise an LCD or other type of electronic display.

A time increase button 38 is coupled to the outer wall 22 of the housing 16 and the time increase button 38 is electrically coupled to the control circuit 26. The time increase button 38 increases the time that the heating element 30 is turned on toward the maximum time. A time decrease button 40 is coupled to the outer wall 22 of the housing 16 and the time decrease button 40 is electrically coupled to the control circuit 26. The time decrease button 40 decreases the time that the heating element 30 is turned on toward the minimum time. Additionally, the electronic timer 28 turns the heating element 30 off when the electronic timer 28 counts down the time set by the time increase button 38 or the time decrease button 40. A time display 42 is coupled to the outer wall 22 of the housing 16 and the time display 42 is electrically coupled to the control circuit 26. The time display 42 displays time indicia comprising numbers indicating the time to which the heating element 30 has been set. The time display 42 may comprise an LCD or other type of electronic display.

A power cord 44 is coupled to and extends outwardly from the housing 16. The power cord 44 is electrically coupled to the control circuit 26. The power cord 44 has a distal end 46 with respect to the housing 16 and a male plug 48 is electrically coupled to the distal end 46. The male plug 48 is electrically coupled to a power source 50 comprising a female electrical outlet.

A canister 52 is removably coupled to the heating unit 12 such that the canister 52 is in thermal communication with the heating unit 12. A fluid 54, such as water or other non-toxic fluid, is poured into the canister 52. Thus, the heating unit 12 can heat the fluid 54 into a steam 56 when the heating unit 12 is turned on. The canister 52 has a bottom wall 58 and an outside wall 60 extending upwardly therefrom. The outside wall 60 has an outer surface 62 and the outer surface 62 is threaded adjacent to the bottom wall 58. The outer surface 62 threadably engages the inside surface 24 of the outer wall 22 of the housing 16 having the bottom wall 58 engaging the heating element 30. The canister 52 is comprised of a heat resistant, non-porous material such as ceramic, stainless steel or other medical grade material thereby facilitating the canister 52 to be effectively sterilized A box 64 is provided and the box 64 is positionable over the heating unit 12 for having a user sitting upon the box 64. The box 64 has a steam opening 66 therein to direct the steam 56 onto the user's genitalia for therapeutic purposes. The box 64 is collapsible between a deployed position and a collapsed position. Additionally, the box 64 substantially surrounds the heating unit 12 to capture the steam 56 for directing onto the user's genitalia. The box 64 is comprised of a heat resistant, non porous material such as ceramic, stainless steel or other medical grade material thereby facilitating the box 64 to be effectively sterilized. Additionally, the box 64 can support the weight of an average human being.

The box 64 has an upper wall 67, an outside wall 68 and a hinge 69. The outside wall 68 of the box 64 has a first lateral side 70, a second lateral side 72, a front side 74 and a back side 76. The steam opening 66 extends through the upper wall 67 and the hinge 69 coupled to a bottom surface 78 of the upper wall 67. Each of the first lateral side 70 and the second lateral side 72 comprise a first half 80 that is hingedly coupled to a second half 82. A top edge 84 of the first half 80 of each of the first lateral side 70 and the second lateral side 72 of the outside wall 68 is coupled to the hinge 69.

Each of the first half 80 and the second half 82 is positionable in a folded position having the back side 76 being positioned adjacent to the front side 74. In this way the box 64 is positioned in the collapsed position. Each of the first half 80 and the second half 82 is positionable in an unfolded position having the back side 76 being spaced from the front side 74. In this way the box is positioned in the deployed position. The outside wall 60 of the box 64 is positionable around the heating unit 12 and the canister 52. Additionally, the steam opening 66 is aligned with the canister 52 and the user sits upon the upper wall 67 of the box 64.

In use, the canister 52 is filled with water, or a mixture of water and herbs, depending on the user's preference. The canister 52 is positioned on the heating unit 12 and the heating unit 12 is turned on. The box 64 is positioned around the heating unit 12 and the user sits upon the upper wall 67 of the box 64. Thus, the user's genitalia are aligned with the steam opening 66 to receive the steam 56 produced by the heating unit 12. In this way the user can apply genital steam 56 therapy in the comfort of their own home or other private location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A genital steaming assembly being configured to produce a heated steam for cleansing genitalia, said, assembly comprising:

a heating unit, said heating unit being positionable on a support surface, said heating unit being adjustable to heat a fluid to a temperature between a minimum temperature and a maximum temperature;

a canister, said canister being removably coupled to said heating unit such that said canister is in thermal communication with said heating unit, said canister holding the fluid wherein said heating unit is configured to heat the fluid into a steam;

a box, said box being positionable over said heating unit, said box being configured for a user to sit upon said box, said box having a steam opening therein wherein said box is configured to direct the steam onto the user's genitalia for therapeutic purposes, said box being collapsible between a deployed position and a collapsed position, said box substantially surrounding said heating unit wherein said box is configured to capture the steam for directing onto the user's genitalia; and wherein said heating unit comprises a housing having a top end, a bottom end and an outer wall extending therebetween, said top end being open, said outer wall having an inside surface, said inside surface being threaded adjacent to said top end.

2. The assembly according to claim 1, wherein said heating unit includes:

a control circuit coupled to said housing; and an electronic timer coupled to said housing, said electronic timer being electrically coupled to said control circuit.

3. The assembly according to claim 2, wherein said heating unit includes a heating element positioned in said housing, said heating element being spaced downwardly from said top end of said housing, said heating element being electrically coupled to said control circuit, said heating element being heated when said heating element is turned on.

4. The assembly according to claim 3, wherein said heating unit includes:

a temperature increase button coupled to said outer wall of said housing, said temperature increase button being electrically coupled to said control circuit, said temperature increase button increasing the temperature of said heating element toward said maximum temperature; and a temperature decrease button coupled to said outer wall of said housing, said temperature decrease button being electrically coupled to said control circuit, said temperature decrease button decreasing the temperature of said heating element toward said minimum temperature.

5. The assembly according to claim 4, wherein said heating unit includes a temperature display coupled to said outer wall of said housing, said temperature display being electrically coupled to said control circuit, said temperature display displaying temperature indicia comprising numbers indicating the temperature to which said heating element has been set.

6. The assembly according to claim 5, wherein said heating unit includes:

a time increase button coupled to said outer wall of said housing, said time increase button being electrically coupled to said control circuit, said time increase button increasing the time that said heating element is turned on toward said maximum time; and a time decrease button coupled to said outer wall of said housing, said time decrease button being electrically coupled to said control circuit, said time decrease button decreasing the time that said heating element is turned on toward said minimum time, said electronic timer turning said heating element oft when said electronic timer counts down the time set by said time increase button or said time decrease button.

7. The assembly according to claim 6, wherein said heating unit includes a time display coupled to said outer wall of said housing, said time display being electrically coupled to said control circuit, said time display displaying time indicia comprising numbers indicating the time to which said heating element has been set.

8. The assembly according to claim 7, further comprising a power cord coupled to and extending outwardly from said housing, said power cord being electrically coupled to said control circuit, said power cord having a distal end with respect to said housing, said distal end having a male plug being electrically coupled thereto, said male plug being electrically coupled to a power source comprising a female electrical outlet.

9. The assembly according to claim 3, wherein said canister has a bottom wall and an outside wall extending upwardly therefrom, said outside wall having an outer surface, said outer surface being threaded adjacent to said bottom wall, said outer surface threadably engaging said inside surface of said outer wall of said housing of said heating unit having said bottom wall engaging said heating element.

10. The assembly according to claim 9, wherein said box has an upper wall, an outside wall and a hinge, said outside wall of said box having a first lateral side, a second lateral side and a front side, said steam opening extending through said upper wall, said hinge being coupled to a bottom surface of said upper wall.

11. The assembly according to claim 10, wherein each of said first lateral side and said second lateral side comprises a first half being hingedly coupled to a second half, a top edge of said first half of each of said first lateral side and said second lateral side of said outer wall being coupled to said hinge, each of said first half and said second half being positionable in a folded position having said back side being positioned adjacent to said front side, each of said first half and said second half being positionable in an unfolded position having said back side being spaced from said front side.

12. The assembly according to claim 11, wherein said outside wall of said box is positionable around said heating unit and said canister having said steam opening aligned with said canister therein said upper wall is configured to have the user sit thereupon.

13. A genital steaming assembly being configured to produce a heated steam for cleansing genitalia, said assembly comprising:

a heating unit positionable on a support surface, said heating unit being adjustable to heat a fluid to a temperature between a minimum temperature and a maximum temperature, said heating unit comprising:

a housing having a top end, a bottom end and an outer wall extending therebetween, said top end being open, said outer wall having an inside surface, said inside surface being threaded adjacent to said top end;

a control circuit coupled to said housing;

an electronic timer coupled to said housing, said electronic timer being electrically coupled to said control circuit;

a heating element positioned in said housing, said heating element being spaced downwardly from said top end of said housing, said heating element being electrically coupled to said control circuit, said heating element being heated when said heating element is turned on;

a temperature increase button coupled to said outer wall of said housing, said temperature increase button being electrically coupled to said control circuit, said temperature increase button increasing the temperature of said heating element toward said maximum temperature;

a temperature decrease button coupled to said outer wall of said housing, said temperature decrease button being electrically coupled to said control circuit, said temperature decrease button decreasing the temperature of said heating element toward said minimum temperature;

a temperature display coupled to said outer wall of said housing, said temperature display being electrically coupled to said control circuit, said temperature display displaying temperature indicia comprising numbers indicating the temperature to which said heating element has been set;

a time increase button coupled to said outer wall of said housing, said time increase button being electrically coupled to said control circuit, said time increase button increasing the time that said heating element is turned on toward said maximum time, a time decrease button coupled to said outer wall of said housing, said time decrease button being electrically coupled to said control circuit, said time decrease button decreasing the time that said heating element is turned on toward said minimum time, said electronic timer turning said heating element off when said electronic timer counts down the time set by said time increase button or said time decrease button;

a time display coupled to said outer wall of said housing, said time display being electrically coupled to said control circuit, said time display displaying time indicia comprising numbers indicating the time to which said heating element has been set; and a power cord coupled to and extending outwardly from said housing, said power cord being electrically coupled to said control circuit, said power cord having a distal end with respect to said housing, said distal end having a male plug being electrically coupled thereto, said male plug being electrically coupled to a power source comprising a female electrical outlet;

a canister removably coupled to said heating unit such that said canister is in thermal communication with said heating unit, said canister having a fluid being poured therein wherein said heating unit is configured to heat the fluid into a steam, said canister having a bottom wall and an outside wall extending upwardly therefrom, said outside wall having an outer surface, said outer surface being threaded adjacent to said bottom wall, said outer surface threadably engaging said inside surface of said outer wall of said housing of said heating unit having said bottom wall engaging said heating element; and a box positionable over said heating unit for having a user sitting upon said box, said box having a steam opening therein wherein said box is configured to direct the steam onto the user's genitalia for therapeutic purposes, said box being collapsible between a deployed position and a collapsed position, said box substantially surrounding said heating unit wherein said box is configured to capture the steam for directing onto the user's genitalia, said box having an upper wall, an outside wall and hinge, said outside wall of said box having a first lateral side, a second lateral side, a front side and a back side, said steam opening extending through said upper wall, said hinge being coupled to a bottom surface of said upper wall, each of said first lateral side and said second lateral side comprising a first half being hingedly coupled to a second half, a top edge of said first half of each of said first lateral side and said second lateral side of said outer wall being coupled to said hinge, each of said first half and said second half being positionable in a folded position having said back side being positioned adjacent to said front side, each of said first half and said second half being positionable in an unfolded position having said back side being spaced from said front side, said outside wall of said box being positionable around said heating unit and said canister having said steam opening being aligned with said canister therein said upper wall is configured to have the user sit thereupon.

* * * * *